US007859428B2

(12) United States Patent
Boss et al.

(10) Patent No.: US 7,859,428 B2
(45) Date of Patent: Dec. 28, 2010

(54) SYSTEM AND METHOD FOR ELECTRONIC ROAD SIGNS WITH IN-CAR DISPLAY CAPABILITIES

(75) Inventors: Gregory Jensen Boss, Saginaw, MI (US); Rick Allen Hamilton, II, Charlottesville, VA (US); Alexandre Polozoff, Bloomington, IL (US); Timothy Moffett Waters, Hiram, GA (US)

(73) Assignee: International Business Machines Corporation, Armonk, NY (US)

( * ) Notice: Subject to any disclaimer, the term of this patent is extended or adjusted under 35 U.S.C. 154(b) by 218 days.

(21) Appl. No.: 12/119,659

(22) Filed: May 13, 2008

(65) Prior Publication Data

US 2009/0284394 A1 Nov. 19, 2009

Related U.S. Application Data

(62) Division of application No. 11/358,753, filed on Feb. 21, 2006, now Pat. No. 7,382,276.

(51) Int. Cl.
*G08G 1/09* (2006.01)
*G08G 1/00* (2006.01)

(52) U.S. Cl. ..... 340/905; 701/117

(58) Field of Classification Search ..... 340/905, 340/908

See application file for complete search history.

(56) References Cited

U.S. PATENT DOCUMENTS 3,754,209 A * 8/1973 Molloy et al. ..... 340/912
6,057,785 A 5/2000 Guthrie
6,246,948 B1 6/2001 Thakker
6,442,473 B1 8/2002 Berstis et al.
6,487,500 B2 11/2002 Lemelson et al.
6,515,596 B2 * 2/2003 Awada ..... 340/905
6,731,940 B1 5/2004 Nagendran
6,747,574 B2 6/2004 Butzer et al.
6,778,074 B1 8/2004 Cuozzo
6,781,523 B2 8/2004 Matsui et al.
7,034,741 B2 * 4/2006 Chon et al. ..... 342/42
7,079,048 B2 7/2006 Kataoka
7,109,884 B2 * 9/2006 Glynn ..... 340/907

(Continued)

OTHER PUBLICATIONS

Non-Final Office Action dated Apr. 1, 2010 for U.S. Appl. No. 12/152,965.

(Continued)

*Primary Examiner*—Benjamin C Lee
*Assistant Examiner*—Sigmund Tang
(74) *Attorney, Agent, or Firm*—Schmeiser, Olsen & Watts; William H. Steinberg

(57) ABSTRACT

The present invention is method and system for delivering road sign content information to a mobile computing device for display to the driver of a vehicle. The system consists of a wireless communication network in communication with a mobile computing device operationally coupled to a dashboard display device or a vehicle head's up display device. The wireless communication network further comprises a plurality of meshed network sign transmitting devices placed along predetermined intervals along the highway. Each sign-transmitting device is capable of transmitting road sign content information to the mobile computing device for display to the driver.

9 Claims, 7 Drawing Sheets

U.S. PATENT DOCUMENTS

| | | | | |
|---|---|---|---|---|
| 7,382,274 | B1 | 6/2008 | Kermani et al. | |
| 7,382,276 | B2 | 6/2008 | Boss et al. | |
| 7,609,172 | B2 * | 10/2009 | Rozum et al. | 340/901 |
| 2003/0191585 | A1 * | 10/2003 | Sakamoto et al. | 701/211 |
| 2004/0113766 | A1 * | 6/2004 | Perlman | 340/468 |
| 2004/0178928 | A1 * | 9/2004 | Butzer et al. | 340/908 |
| 2004/0196161 | A1 | 10/2004 | Bell et al. | |
| 2004/0201496 | A1 | 10/2004 | Hering et al. | |

OTHER PUBLICATIONS

Non-Final Office Action dated Sep. 27, 2007 for U.S. Appl. No. 11/358,753.

Final Office Action dated Jan. 28, 2008 for U.S. Appl. No. 11/358,753.

Notice of Allowance dated Apr. 4, 2008 for U.S. Appl. No. 11/358,753.

* cited by examiner

[Header Protocol | Road Sign Data Message | Trailer Protocol]

Road Sign Data Message Attributes

Identification – identifies the type of sign to display
Shape- identifies shape of sign to display
Color – identifies color of sign to display
TEXT 1 – identifies actual textual data to display
TEXT 1 Location – identifies where actual textual data is to be displayed
TEXT - - TEXT N – identifies additional information
Transmitter ID – identifies whether it's the first transmitter or the backup transmitter
OK – transmit OK signal
Sign Location

FIG. 5

SYSTEM AND METHOD FOR ELECTRONIC ROAD SIGNS WITH IN-CAR DISPLAY CAPABILITIES

This application is a divisional application claiming priority to U.S. patent application Ser. No. 11/358,753, filing date Feb. 21, 2006, U.S. Pat. No. 7,382,276, issued Jun. 06, 2008.

FIELD OF THE INVENTION

This invention relates generally to wireless communications systems. More particularly, this invention relates to wireless communication systems for supporting in-car mobile computing devices.

BACKGROUND OF THE INVENTION

Highway traffic control devices and procedures help vehicles safely share the same highways. These traffic control procedures establish rules and instructions that help drivers avoid collisions. With million of motorists on the highways, traffic control devices are required to avoid collisions and ensure that motorists travel safely to their destinations. Traffic control includes textual signs, traffic lights, and other devices that communicate specific directions, warnings, or requirements. With over 55 million traffic signs in use today in the United States, textual traffic signs are the most extensive form of traffic control in use today.

Global Positioning System (GPS) is a space-based radio navigation system consisting of 24 satellites and ground support. GPS provides users with accurate information about their position and velocity, as well as the time, anywhere in the world and in all weather conditions. GPS receivers are now available for installation in vehicles. A user with a GPS receiver can determine latitude, longitude, and altitude. The receiver triangulates its exact position by measuring the transmission time of at least three satellite signals to the GPS receiver. With a GPS receiver, a driver can effectively navigate to a particular location. However, GPS systems have no means for displaying anything other than street names and points of interests.

The growth in wide use of mobile computing devices such as PDA's, cell phones, notebooks, and other portable computing devices has driven the advancement of wireless networks. Wireless networks use either infrared or radio-frequency transmissions to link these mobile computing devices. Wireless wide area networks (WANs) can use cellular telephone networks, satellite communications or another suitable proprietary network.

Because of visibility limitations due to lighting conditions, improper placed signs, road conditions, sign clutter, a driver can miss a pertinent textual traffic sign or commit a traffic violation. Thus, what is needed is a system and method of transmitting road sign content information on a display device located within a vehicle utilizing a wireless communication network

SUMMARY OF THE INVENTION

One of the major objectives of the present invention is the migrating of existing textual road signs to simple hidden wireless network system transmitters that transmit the road sign content directly into an in-car display system.

Another objective of the present invention is to provide the added capability of transmitting road sign content information directly into hand-held devices.

Another objective of the present invention is to provide a simple user interface for the in-car display system that is not a distraction to drivers.

In one embodiment of the present invention the system consists of a wireless communication network in communication with a mobile computing device operationally coupled to a dash board display device or a vehicle head's up display device. The wireless communication network further comprises a plurality of meshed network sign transmitting devices placed along predetermined intervals along the highway. Each sign-transmitting device is capable of transmitting road sign content information to the mobile computing device for display to the driver. In another embodiment of the present invention, the user can request the system to filter out specific messages and display only the user requested road signs. Additionally, upon the malfunction of the sign transmission device, a redundant backup sign transmission device can be automatically activated.

BRIEF DESCRIPTION OF THE DRAWINGS

The above and other aspects, features and advantages of the present invention will be more apparent from the following more particular description thereof, presented in conjunction with the following drawings wherein:

FIG. 5 is an example of the content of a transmitted sign message.

DETAILED DESCRIPTION OF THE INVENTION

Although the following description contains specific implementation details for the purposes of illustration, one skilled in the art will appreciate that many variations and alterations to the following details are within the scope of the present invention. Accordingly, the following preferred embodiment of the invention is set forth without any loss of generality, and without imposing limitations upon, the claimed invention.

The present invention employs methods and systems for delivering road sign content information to a mobile computing device for display to the driver of a vehicle. More specifically, sign transmitting devices are installed along the highway. As a vehicle adapted with a receiving mobile computing device enters the range of a sign-transmitting device, the road sign content information is received and displayed to the driver of the vehicle.

Figure 1:
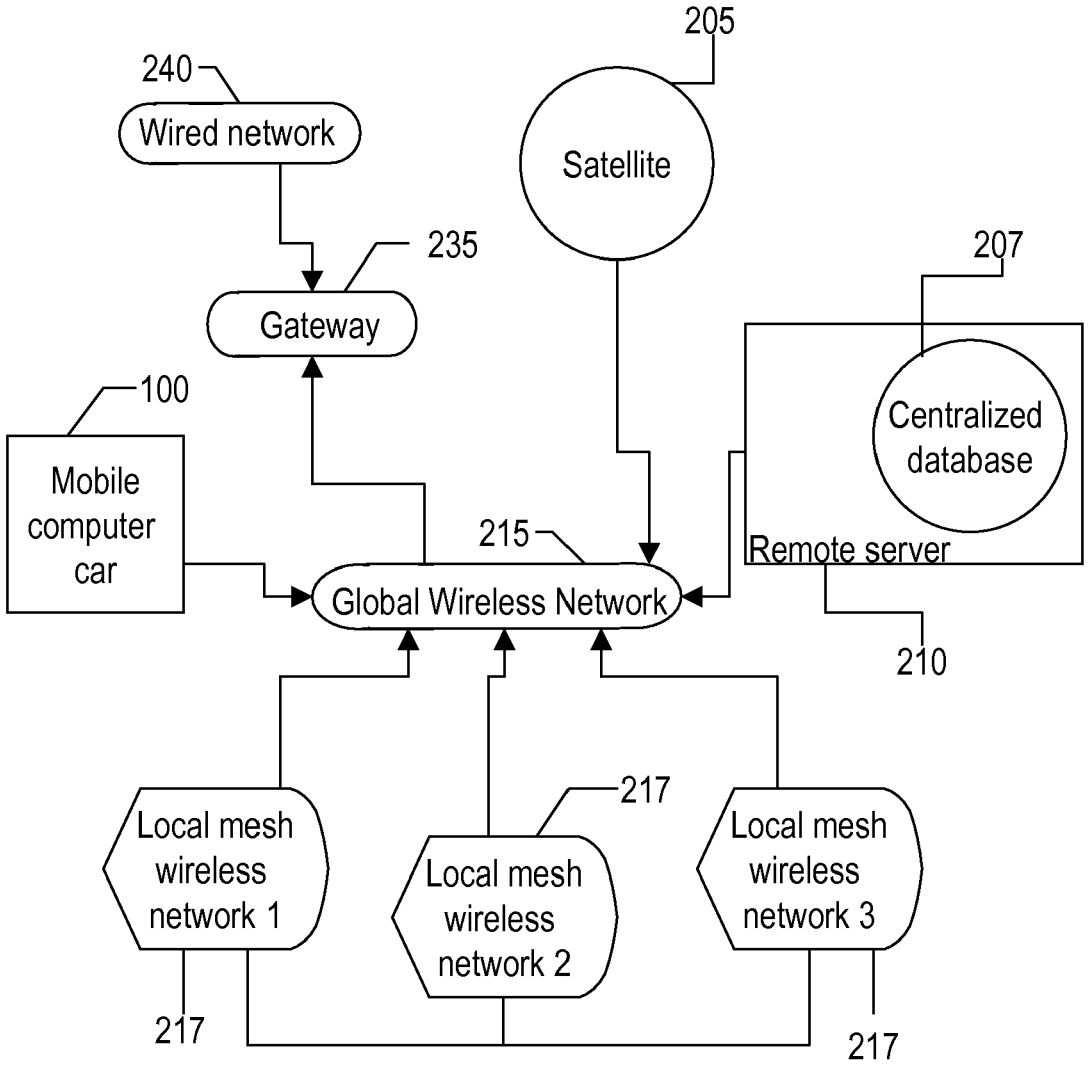
FIG. 1 is a functional block diagram illustrating the wireless network architecture.

Referring to FIG. 1, there is shown one embodiment of a wireless network infrastructure 200 to support the present invention. The wireless network infrastructure 200 is supported by a group of interconnected local mesh wireless area networks 217 forming a global wireless network 215. Local wireless network 217 can be supported by conventional radio, microwave, or satellite systems using conventional wireless access protocols. For example, the cellular phone network uses the radio wave transmission technology while WiMAX uses microwave transmission technology. Wireless middleware software such as the Wireless Access Protocol (WAP) facilitates interoperability among different wireless networks, devices, and applications. The WAP client software supports text, graphics, and standard Web Content for wireless network.

To support an interface with other applications, the global wireless network 215 can be connected to a wired wide area network through a conventional gateway 235. For example, mobile computer 100 in the car may need to interface with the Internet applications. Additionally, mobile computer 100 may need to interface with the GPS satellite systems. To support maintenance of the local area networks 217, a remote server 210 with database 207 can be programmed to interface with and monitor transmissions from each sign transmission device within global wireless network 215.

Figure 2:
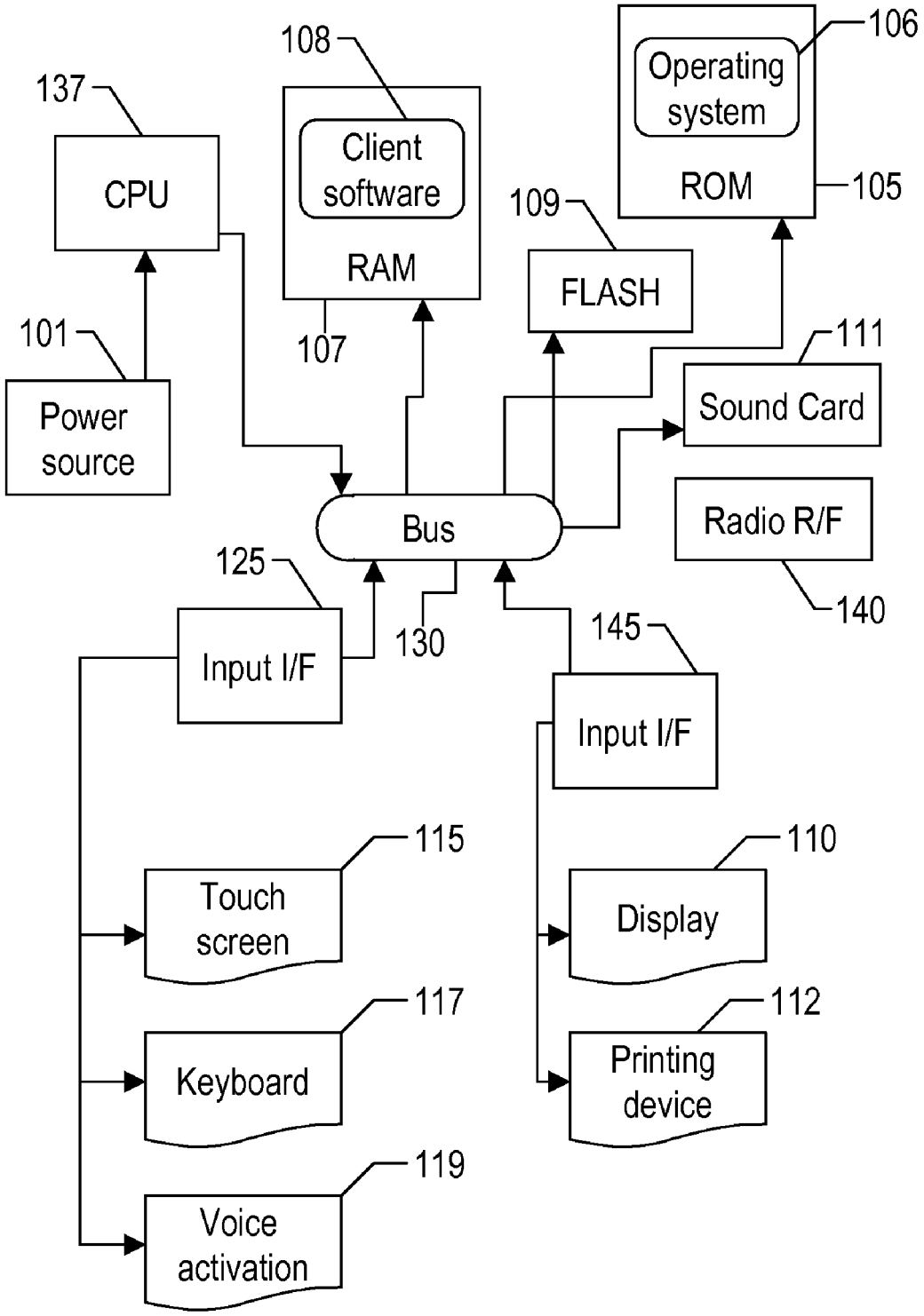
FIG. 2 is a functional block diagram of the mobile computer within the car.
Figure 3:
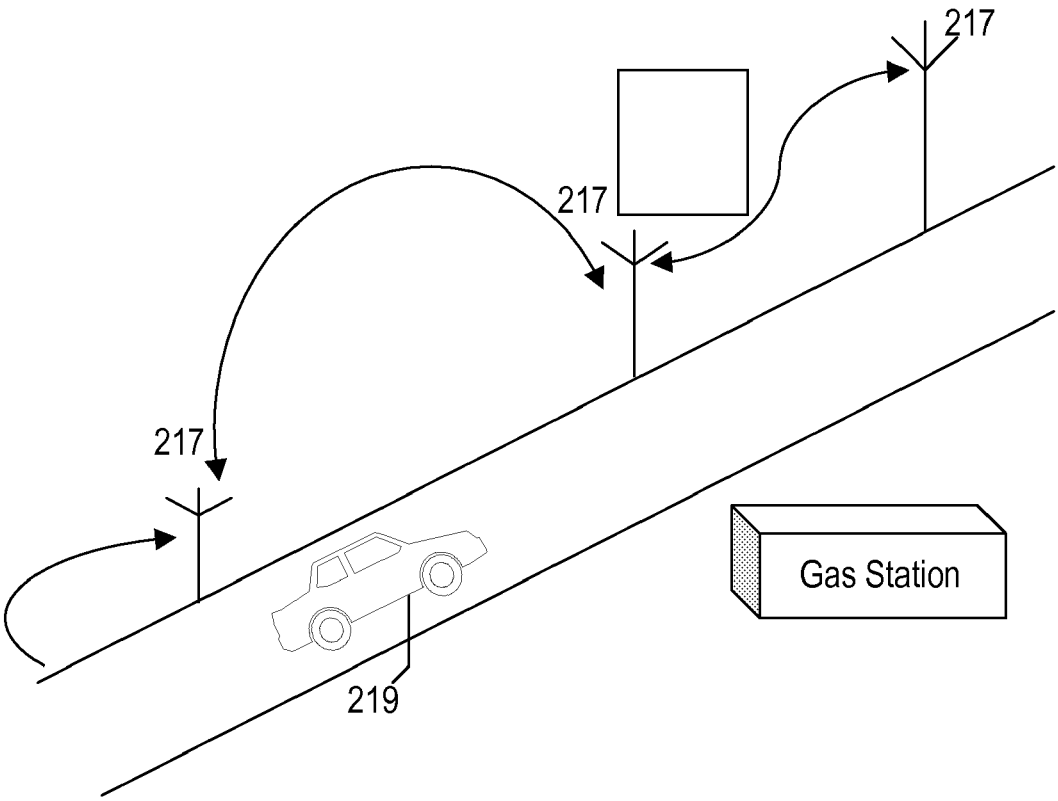
FIG. 3 is a functional block diagram illustrating the metropolitan wireless network architecture.

Referring to FIG. 3, there is shown one embodiment of the local wireless area network 217 for supporting a particular geographic location. Within a specific local mesh wireless area network 217, a plurality of sign transmission devices 218 are installed at predetermined locations along the highway. Mobile computer 100 depicted in FIG. 2 is installed within a vehicle 219.

To support the present invention a mobile computing device 100 is required with sufficient memory, a display and communication facilities. FIG. 2 illustrates one embodiment of mobile computing device 100. Mobile computing device 100 can be built-in into the current computer system of the vehicle or can be a separate hand-held computing device.

A typical mobile computing device 100 includes a central processing unit (CPU), storage devices, input devices, and output devices. As shown the mobile computing device 100 includes CPU 137, input interface 125, output interface 145, and radio communication facilities 140. CPU 137 is the computer hardware component that actually interprets and performs the computer software instructions. With computers, bus 130 enables the components of the computer to communicate.

Output interface 145 includes device driver software to support communication interface with the output devices—display 110, sound card 110, and printing device 112. In the present invention, display 110 is required to display the transmitted road sign content. Display 110 can be an in-dash mounted display or a heads up mounted display. Display 110 can be a flat liquid crystal display (LCD) or another suitable display device. Sound card 110 can be used to support a small speaker system. If required, an interface to a printing device 112 can be added for printing out road content information.

Input interface 125 includes software to support the user interface as well as the interface with input devices—touch screen 115, keyboard 117, and voice activation 119. The user interface in conjunction with the input devices allows the user to communicate with the mobile computing device. The present invention requires a simple user interface that is predominately hands-off. Thus, in the present invention, the user interface can be implemented in a combination of ways. A simple touch screen interface in conjunction with simple voice activation commands can be utilized. Another possible implementation is a simple keypad function interface.

The mobile computing device 100 further comprises memory to provide storage for the operating system 106 and the client software 107, which is described in detail below. Memory to support the present invention can include read only memory (ROM) 105, which preferable provides storage for the operating system. Flash memory 109 as well as random access member (RAM) can be used to store customized client software 107.

An operating system 106 is needed to manage the computer hardware components mentioned above. Additionally, the operating system loads the computer software (i.e. client software 108) into memory and executes the instructions of the computer software. The supporting operating system 106 needs to be small and have reduced storage needs. For example, since UNIX is widely used and has interoperability features, a stripped down version of UNIX can adapted to be used in the present invention.

Mobile computer 100 requires some type of electrical power source. In the present invention if mobile computer 100 is built into the vehicle, the power source can be the car battery with a possible rechargeable battery backup. However, if mobile computer 100 is a hand-held device, the power source is a rechargeable battery. Radio RF 140 uses radio wave technology to support communication with the wireless network infrastructure. RF 140 supports the reception of the road sign content messages sent onto the wireless network infrastructure by the plurality of sign transmission devices.

Figure 4:
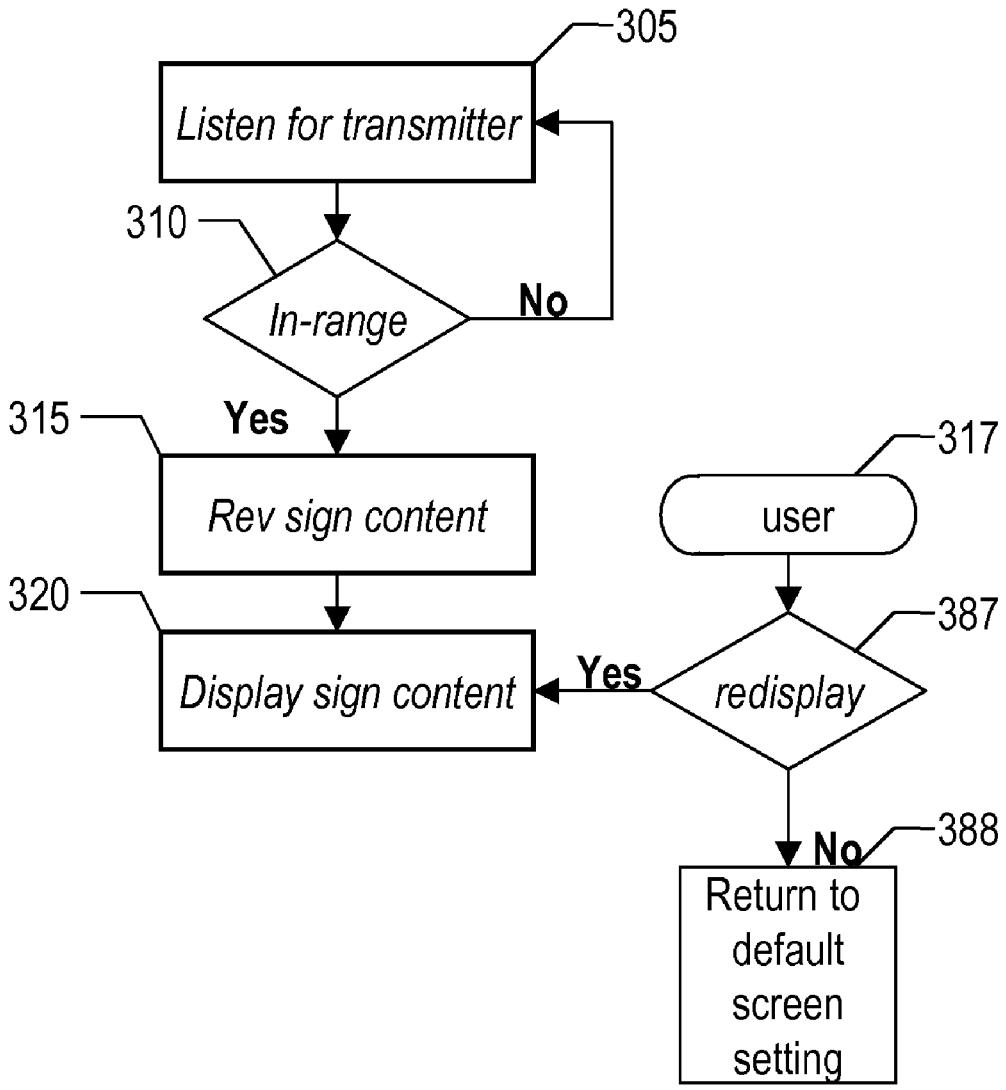
FIG. 4 is a flow chart of the software architecture supporting the road sign content transmission process of the present invention.

FIG. 4 illustrates a flow chart of one embodiment of the road sign content transmission process. At step 305, the system continuously listens for the messages transmitted by the sign transmitters. At step 310, when the mobile computing device receiver 100 is in range of a sign transmission device 218 (shown in FIG. 2), the system proceeds to step 315 to capture the message.

At step 320, the system interprets the message. Based upon the road sign identification and other attributes contained in the message, the system displays the road sign content on the display of the mobile computing device. The road sign content can be displayed for an indefinite time period, such as until the next relevant sign comes into range of the receiver. In an alternative approach, the road sign can be displayed for a predetermined period of time, for example 30 seconds to one minute. At step 317, the user has the option of redisplaying the road sign content information in step 387. In this approach of the limited display time, if the user does not want to redisplay the sign content, the screen returns to a default screen in step 388 until the receiver is in range of the next sign transmission device.

Figure 4A:
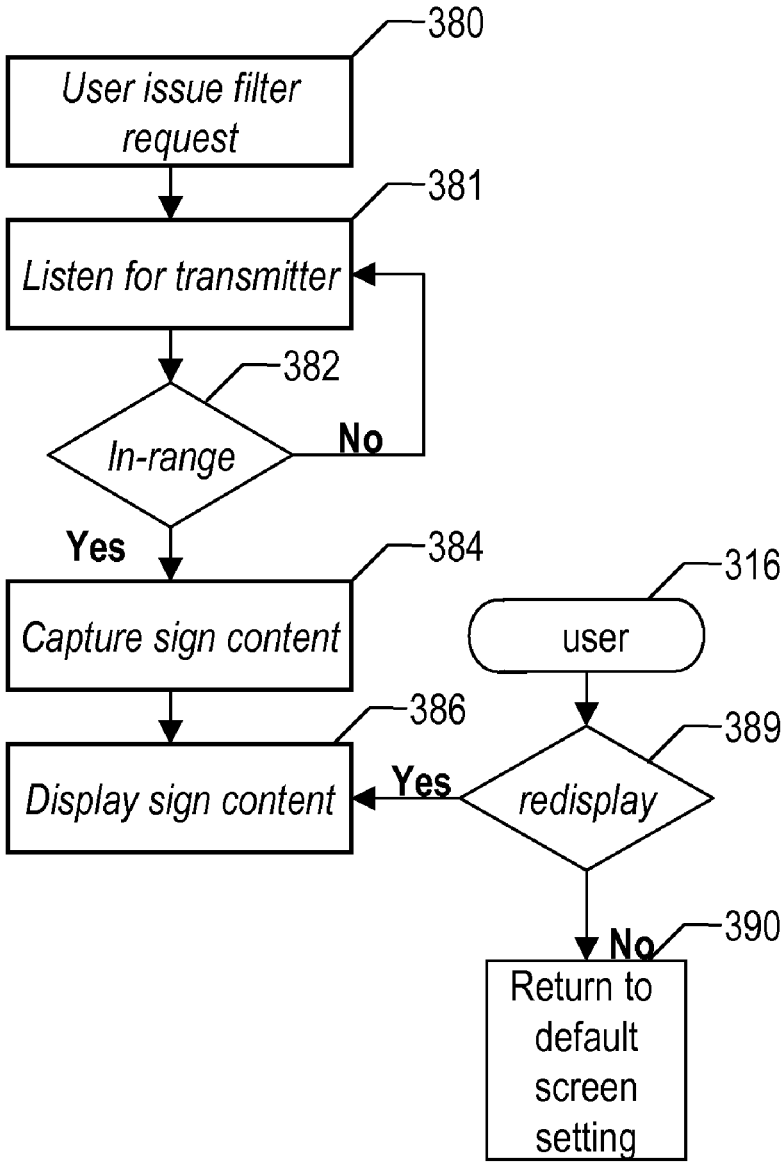
FIG. 4A is a flow chart of the software architecture supporting filtering process of the road sign content transmission.

FIG. 4A illustrates a flow chart of one embodiment of filtering process of road sign content transmissions implemented within the present invention. At step 380, the user issues a filtering request. At step 381, the system continuously listens for the messages transmitted by the sign transmitters. At step 382, when the mobile computing device 100 receiver is in range of a sign transmission device 216 (shown in FIG. 2), the system proceeds to step 384 to capture the message. At step 386, the system interprets and displays the message content of the sign. Based upon the user filter request, the road sign identification and other attributes contained in the message, the system displays the road sign content on the display of the mobile computing device. For example a user can request to display only speed limit signs, mileage signs, restaurant signs, gas station signs, or another suitable traffic control sign. Additionally, the user can request a combination of signs together. In the same manner as FIG. 4, the road sign content can be displayed for an indefinite time period, such as until the next relevant sign comes into range of the receiver and the information from that sign will replace the current sign content of the display. In the alternative approach, the road sign can be displayed for a predetermined period of time, for example 30 seconds to one minute. At step 316, the user has the option of redisplaying the road sign content information in step 389. In this approach of the limited display time, if the user does not want to redisplay the sign content, the screen returns to a default screen in step 390 until the receiver is in range of the next sign transmission device.

Figure 4B:
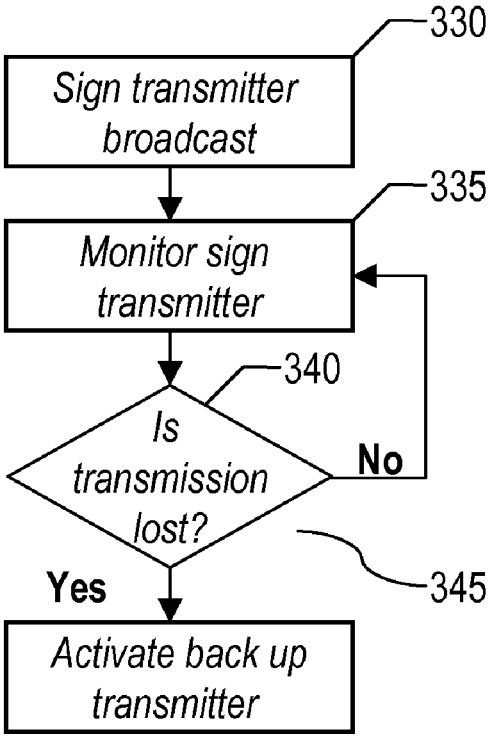
FIG. 4B is a flow chart of one embodiment of the process to support redundant road sign transmitters.

FIG. 4B illustrates a flow chart of one embodiment for supporting redundant backup sign transmitters. At step 330, road sign transmitters 218 depicted in FIG. 2 continuously transmits an OK signal that indicates that they are working properly. At step 335, the system monitors the OK signal. At step 340, if the OK signal is lost, then the system proceeds to activate the backup sign transmitter 219 in step 345. The monitoring can be periodic checks of the transmitted signal. When a check in step 340 determines that there is a signal, the process returns to the monitoring step 335.

Figure 4C:
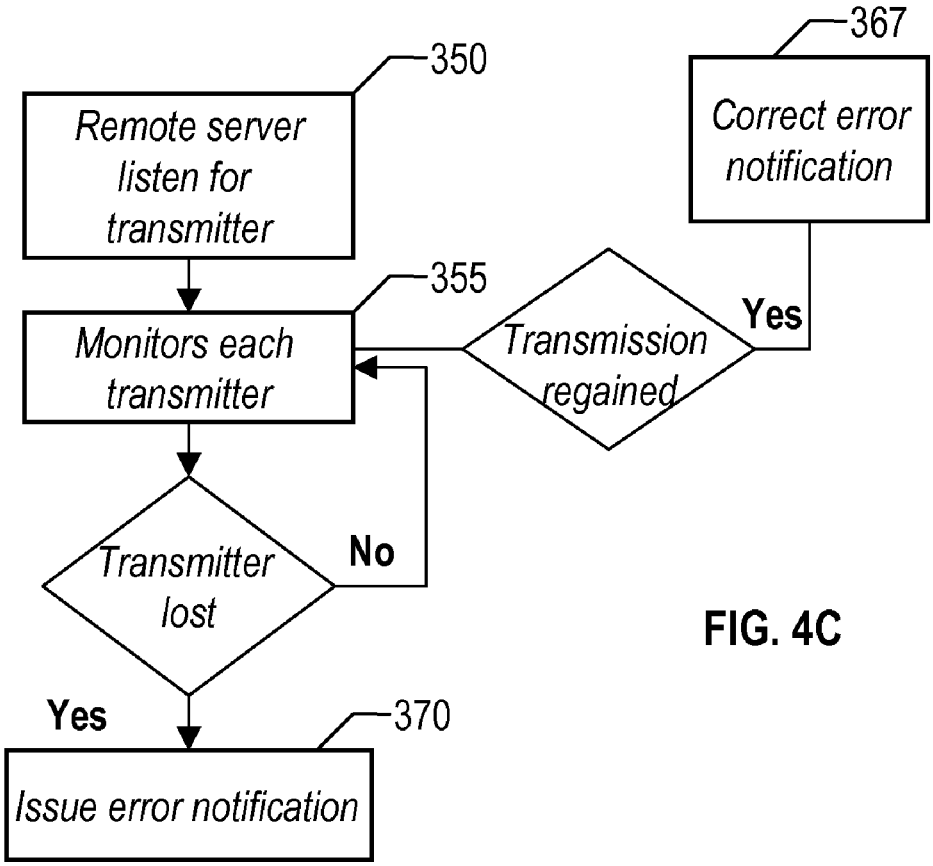
FIG. 4C is a flow chart of one embodiment of the process to support maintenance of the road sign transmitters.

FIG. 4C is a flow chart of one embodiment for supporting maintenance of the sign transmitters. At step 350, the remote server 210 depicted in FIG. 1 listens for the OK transmission signal of each sign transmitter and stores this information in a database 207 depicted in FIG. 1. At step 355, the system monitors each sign transmitter that is in its database. At step 365 if an OK signal is lost, the system proceeds to step 370 to issue an error notification notifying a user the location of the malfunctioning sign transmitter. The system logs the error information in a database 207. At step 367, the system continuously monitors OK signals to determine if a previously lost signal is now retransmitting. If so, the database is corrected along with the error notification.

The information contained in a road sign message sent onto the network can vary. The chart gives an example of the types of information that can be transmitted and received in a system in accordance with the present invention. FIG. 5 is an example of the content of a transmitted sign message. The message contains several attributes such as an identification symbol for the type of sign, the shape of the sign, the color of the sign, the text of the sign, location of the sign and other suitable attributes. These attributes are used by the system to interpret, filter, and display the message onto the display device of the mobile computer. Additionally, the remote server utilizes these attributes to monitor the transmission devices to support maintenance.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. In a wireless communication network comprising a plurality of road signs containing wireless road sign transmitters capable of transmitting signals containing information to mobile computing devices located in motor vehicles, a system for delivering road sign content to the mobile computing devices within motor vehicles, the system comprising:

a road sign transmitter for continuously broadcasting signals onto the wireless communication network a message containing specific road sign content information;

a computing device within a motor vehicle capable of receiving from a motor vehicle occupant display parameters for displaying information with specifically defined content received from road sign transmitters, said computing device also capable of continuously monitoring the wireless communication network for signals being broadcast over the network, the broadcasted signals coming from road sign transmitters;

a receiver within said computing device for capturing a signal transmitted over the wireless communication network, when the signal is in range of the mobile computing device;

a processing component within the receiving device for interpreting information contained in a received signal, determining the road sign content information contained in the signal, storing the captured road sign content information transmitting the captured road sign information to a display device based on one or more display parameters previously defined by a vehicle occupant; and a display device for displaying for a predetermined time period contents of a road sign contained in the captured signal and transmitted to said display device from said processing component.

2. The system of claim 1 wherein the mobile computing device is a hand-held computing device.

3. The system of claim 1 further comprises an interface for securing the mobile computing device into a computing system manufactured as part of the vehicle.

4. The system of claim 1 wherein said processing component for interpreting information contained in a received signal has the ability to retrieve from the retrieved signal a set of attributes that identify the specific type of road sign content contained in the received signal.

5. The system of claim 1 further comprises a device to activate a backup sign transmitter to replace a deactivated sign transmitter.

6. The system of claim 1 wherein the display device further comprises the capability of redisplaying the message for an additional predetermined period of time.

7. The system of claim 1 further comprises an input mechanism in the computing device for accepting a user request to filter and display a specific type of information contained in a received signal transmitted from a road sign transmitter, the filter request containing parameters on which a filtering operation will be base.

8. The system of claim 7 wherein said display device further comprises a mechanism in said computing device for displaying information from a the road sign based upon the user's filtering request.

9. The system claim 1 further comprising: a device for providing a remote server in communication with the plurality of road sign transmitters; a mechanism for continuously monitoring the plurality of sign transmitters to determine their status; and if a sign transmitter malfunctions a computing device means for issuing an error notification.

* * * * *